US009890564B2

(12) United States Patent
Wong et al.

(10) Patent No.: US 9,890,564 B2
(45) Date of Patent: Feb. 13, 2018

(54) INTERCONNECTED LOCK WITH DIRECT DRIVE FOR ADJUSTABLE DEADBOLT TO LATCHBOLT SPACING

(71) Applicant: SARGENT MANUFACTURING COMPANY, New Haven, CT (US)

(72) Inventors: Wai P. Wong, Orange, CT (US); Pavel Farias, Jal. (MX); Gregg Krehel, Newtown, CT (US); Brian Fournier, Canton, CT (US); Todd Zimmer, Meriden, CT (US)

(73) Assignee: Sargent Manufacturing Company, New Haven, CT (US)

( * ) Notice: Subject to any disclaimer, the term of this patent is extended or adjusted under 35 U.S.C. 154(b) by 169 days.

(21) Appl. No.: 14/924,050

(22) Filed: Oct. 27, 2015

(65) Prior Publication Data

US 2016/0115720 A1 Apr. 28, 2016

Related U.S. Application Data

(60) Provisional application No. 62/084,699, filed on Nov. 26, 2014, provisional application No. 62/069,477, filed on Oct. 28, 2014.

(51) Int. Cl.
*E05C 1/06* (2006.01)
*E05C 1/12* (2006.01)
(Continued)

(52) U.S. Cl.
CPC ..... *E05B 53/00* (2013.01); *E05B 15/02* (2013.01); *E05B 63/0056* (2013.01);
(Continued)

(58) Field of Classification Search
CPC ..... Y10T 292/1097; Y10T 292/1098; Y10T 292/096; Y10T 292/1014; Y10T 292/1016;
(Continued)

(56) References Cited

U.S. PATENT DOCUMENTS 5,513,505 A * 5/1996 Dancs ..... E05B 47/026 292/169.13
5,713,612 A * 2/1998 Kajuch ..... E05B 53/00 292/21
5,810,402 A * 9/1998 Armstrong ..... E05B 53/00 292/172
(Continued)

FOREIGN PATENT DOCUMENTS

KR 20080094541 10/2008
WO 2015057503 4/2015

*Primary Examiner* — Daniel J Troy
*Assistant Examiner* — Andres F Gallego
(74) *Attorney, Agent, or Firm* — DeLio, Peterson & Curcio, LLC; David R. Pegnataro

(57) ABSTRACT

An interconnected lock for use on a door, where the lock has adjustable offset spacing between a deadbolt and latchbolt. The lock includes first and second shafts for actuating the deadbolt lock mechanism, at different offset spacings. A linkage arm connected to and moveable by the latchbolt actuator is alternately connectable to rotate either the first or second deadbolt-actuating shaft. The linkage arm has first and second upper positions, for alternate connection to rotate the first and second deadbolt-actuating shafts, respectively. Upon operation of the interior actuator, the linkage arm moves the deadbolt along the second axis from the latched to the unlatched position at the same time that the operation of the interior actuator moves the latchbolt along the first axis from the latched to the unlatched position.

20 Claims, 10 Drawing Sheets

(51) Int. Cl.

| | |
|---|---|
| ***E05C 9/10*** | (2006.01) |
| ***E05B 53/00*** | (2006.01) |
| ***E05B 63/04*** | (2006.01) |
| ***E05B 63/00*** | (2006.01) |
| ***E05B 15/02*** | (2006.01) |
| *E05B 59/00* | (2006.01) |
| *E05B 47/00* | (2006.01) |

(52) U.S. Cl.
CPC ..... *E05B 63/0069* (2013.01); *E05B 63/04* (2013.01); *E05B 59/00* (2013.01); *E05B 2047/0091* (2013.01); *Y10T 70/5226* (2015.04)

(58) Field of Classification Search
CPC ..... Y10T 70/8541; Y10T 70/8838; Y10T 70/8865; Y10T 70/5226; E05B 59/00; E05B 63/0056; E05B 63/04; E05B 63/042; E05B 63/044; E05B 63/06; E05B 63/16; E05B 63/046; E05C 1/08; E05C 1/10
See application file for complete search history.

(56) References Cited

U.S. PATENT DOCUMENTS

| | | | | |
|---|---|---|---|---|
| 7,364,212 | B1 * | 4/2008 | Fan | E05B 1/003 292/33 |
| 8,434,335 | B2 | 5/2013 | Roth et al. | |
| 2010/0022512 | A1 | 9/2010 | Chiang et al. | |
| 2016/0168888 | A1 * | 6/2016 | Farias | E05B 53/00 292/52 |

* cited by examiner

INTERCONNECTED LOCK WITH DIRECT DRIVE FOR ADJUSTABLE DEADBOLT TO LATCHBOLT SPACING

This application claims priority from U.S. patent application No. 62/069,477 filed on Oct. 28, 2014 and from U.S. patent application No. 62/084,699 filed on Nov. 26, 2014.

1. FIELD OF THE INVENTION

The present invention relates to interconnected locks, i.e., locks in which the outside of the door has a latchbolt lock mechanism on the bottom and a separate deadbolt lock mechanism on the top, but on the inside the mechanisms are interconnected so that rotating the inner handle automatically retracts both the latchbolt and the deadbolt, without having to separately unlock the two.

2. DESCRIPTION OF RELATED ART

Many local codes dictate when a deadbolt is in use the lockset must be an interconnected type lockset to allow simultaneous retraction of both the latchbolt and the deadbolt during egress from the inside of the door, i.e., the inside of the house or apartment, or the side of the door for which security is otherwise desired. Existing interconnect products have a fixed center to center distance measured from the center of rotation of the lever handle, where the latchbolt is positioned, to the centerline of the deadbolt. This fixed dimension of latchbolt/deadbolt axis spacing, or offset distance, is typically either 4 in. (102 mm) or 5.5 in. (140 mm) center to center. For new construction projects consumers can specify door preparation so the offset center-to center distance is not so much of an issue. There is a benefit to offering an adjustable interconnected lock for consumers on renovation and retro fit projects where the door is usually not replaced. There is typically a mix in the market place of 4 in. (102 mm) and 5.5 in. (140 mm) door preparations, but in interconnect markets the predominant door preparation is 4 in. (102 mm) as most competitive interconnects are 4 in. (102 mm). In non-interconnect markets the 5.5 in. (140 mm) distance is often used with a deadbolt and passage. The biggest driver for covering both preparations is to comply with the International Building Code (IBC). As more states adopt the IBC interconnected locks will increase in use as single handle motion egress is required. The ability to retrofit both offset distances without re-prepping or buying new doors would be advantageous.

SUMMARY OF THE INVENTION

Bearing in mind the problems and deficiencies of the prior art, it is therefore an object of the present invention to provide an interconnected lock which permits adjustment of deadbolt to latchbolt spacing.

It is another object of the present invention to provide an interconnected lock that is able to switch between different latchbolt-deadbolt offset spacings, and may optionally be re-handed, without adding or removing any components thereof.

A further object of the invention is to provide an interconnected lock that is able to accomplish the switch between different latchbolt-deadbolt spacings without the need for using any tools.

Still other objects and advantages of the invention will in part be obvious and will in part be apparent from the specification.

The above and other objects, which will be apparent to those skilled in the art, are achieved in the present invention which is directed to an interconnected lock for use on a door, where the lock has adjustable offset spacing between a deadbolt and latchbolt. The lock includes a latchbolt mechanism mountable in a first bore through a door and including a latchbolt and an interior actuator operable to move the latchbolt between latched and unlatched positions along a first axis. The lock also includes a deadbolt lock mechanism mountable in a second bore through a door, with the second bore being spaced from the first bore, and has a deadbolt moveable by the deadbolt lock mechanism along a second axis between latched and unlatched positions. The distance between the latchbolt first axis and the deadbolt second axis is the offset spacing. The lock further includes first and second shafts for actuating the deadbolt lock mechanism. The first shaft is disposed at a first offset spacing from the latchbolt first axis and the second shaft is disposed at a second, greater offset spacing from the latchbolt first axis.

The lock additionally includes a driver member connected to and moveable by the latchbolt actuator, the driver member being alternately connectable to rotate either the first deadbolt-actuating shaft or the second deadbolt-actuating shaft, depending on the offset spacing between the latchbolt first axis and the deadbolt second axis. The driver member may be a linkage arm having a lower end connected to and moveable by the latchbolt actuator. The linkage arm has a length extending upwards with first and second upper positions. The first upper linkage arm position has a distance from the lower end sufficient for connection to rotate the first deadbolt-actuating shaft. The second upper linkage arm position has a distance from the lower end sufficient for connection to rotate the second deadbolt-actuating shaft. The first and second upper linkage arm positions are alternately connectable to rotate the first and second deadbolt-actuating shafts, and thereby actuate the deadbolt lock mechanism, depending on the offset spacing between the latchbolt first axis and the deadbolt second axis.

Upon operation of the interior actuator, the linkage arm moves the deadbolt along the second axis from the latched to the unlatched position at the same time that the operation of the interior actuator moves the latchbolt along the first axis from the latched to the unlatched position. The first and second upper linkage arm positions are alternately connectable to rotate the first and second deadbolt-actuating shafts when adjusting or changing spacing between the first and second axes to adjust or change offset spacing between the deadbolt and latchbolt between a first distance and a second, longer distance.

The lock may include a rotatable lower cam operable by the interior actuator, with the lower cam having a pair of arms extending outward on opposite sides thereof. The lock may also include a sliding mechanism that is urged upward by one of the lower cam arms when the interior actuator is rotated. The linkage arm may be urged upward by a lower slider portion of the sliding mechanism to rotate the first or second deadbolt-actuating shafts. An upper slider portion of the sliding mechanism may be connected to the lower slider, and the linkage arm lower end may be connected to the upper slider and extend upward therefrom. The linkage arm lower end may be connected by a pin to the upper slider.

The lock may include first and second upper cam plates, with the first upper cam plate being connected to the first deadbolt-actuating shaft, and the second upper cam plate being connected to the second deadbolt-actuating shaft. The first and second upper linkage arm positions are alternately connectable to the first and second upper cam plates.

The first upper linkage arm position may be connectable to the first upper cam plate by a pin, and the second upper linkage arm position may be connectable to the second upper cam plate by a pin. When the deadbolt is at the first offset spacing, the first upper linkage arm position is connected to the first upper cam plate and the second upper pin position of the linkage is unconnected to the second upper cam plate; when the deadbolt is at the second offset spacing, the second upper linkage arm position is connected to the second upper cam plate and the first upper pin position of the linkage is unconnected to the first upper cam plate. The pins may be located on the cam plates or the linkage arm upper arm positions. The first and second upper linkage arm positions may be alternately connectable to rotate the first and second deadbolt-actuating shafts without adding or removing any components thereof, and without any use of tools.

In another aspect the present invention is directed to a method of adjusting offset spacing between a deadbolt and latchbolt in interconnected lock for use on a door. The method comprises initially providing an interconnected lock of the type described above. If adjusting or changing to a shorter offset spacing distance, the method comprises connecting the first upper linkage arm position to rotate the first deadbolt-actuating shaft and thereby actuate the deadbolt lock mechanism. If adjusting or changing to a longer offset spacing distance, the method comprises connecting the second upper linkage arm position to rotate the second deadbolt-actuating shaft and thereby actuate the deadbolt lock mechanism. The connection of the first and second upper linkage arm positions is accomplished without adding or removing any components thereof.

Yet another aspect of the invention is directed to a method of re-handing or reversing an interconnected lock for use on a door. The method initially comprises providing an interconnected lock of the type described above, wherein the lock further includes first and second upper cam plates. The first upper cam plate is connected to the first deadbolt-actuating shaft, and the second upper cam plate is connected to the second deadbolt-actuating shaft. The first and second upper linkage arm positions are alternately connectable to the first and second upper cam plates. If handing the lock for a right hand operation, the method comprises connecting the linkage arm to one side of the first and second upper cam plates. If handing the lock for a left hand operation, the method comprises connecting the linkage arm to the other side of the first and second upper cam plates.

The first and second upper linkage arm positions may be alternately connectable to the first and second upper cam plates by pins located on either side thereof. If handing the lock for a right hand operation, the linkage arm is connected to a pin on one side of the first and second upper cam plates. If handing the lock for a left hand operation, the linkage arm is connected to a pin on the other side of the first and second upper cam plates.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
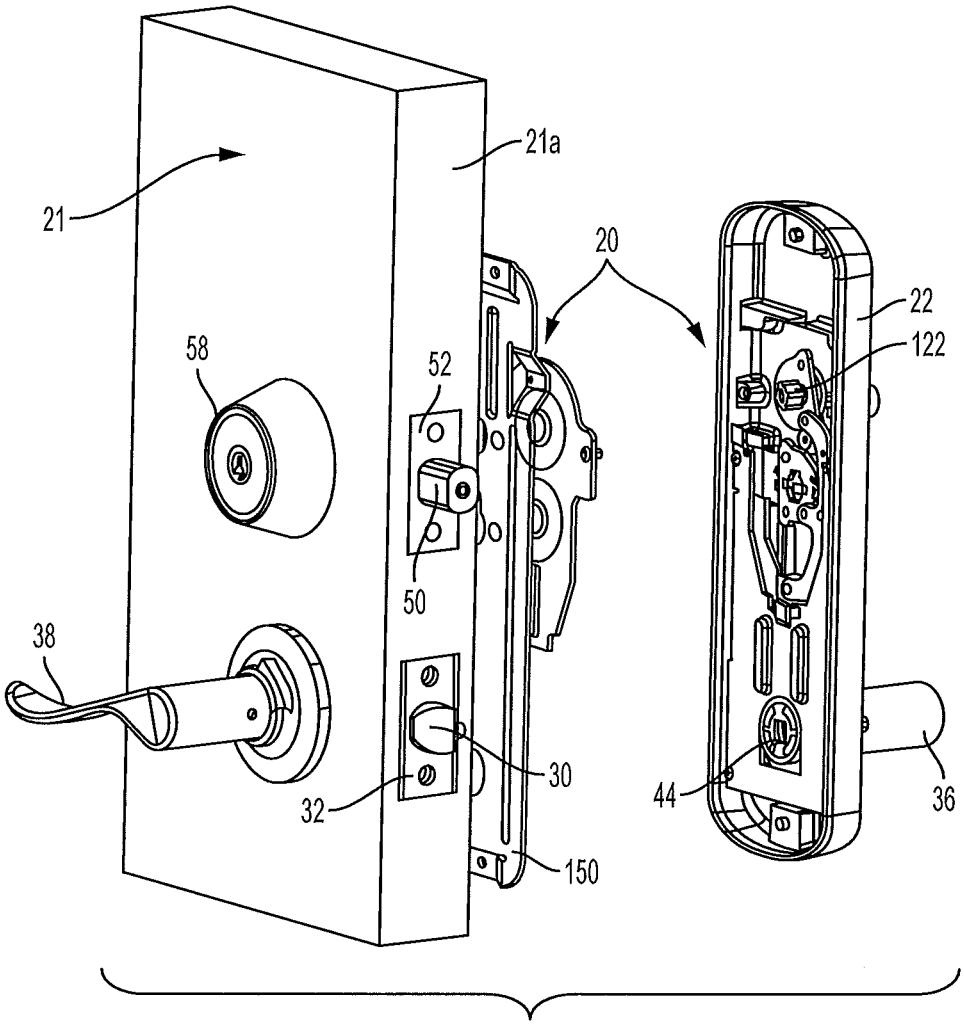
FIG. 1 is an exploded perspective view of an embodiment of the interconnected lock of the present invention for mounting and use on the inside of a door.
Figure 3:
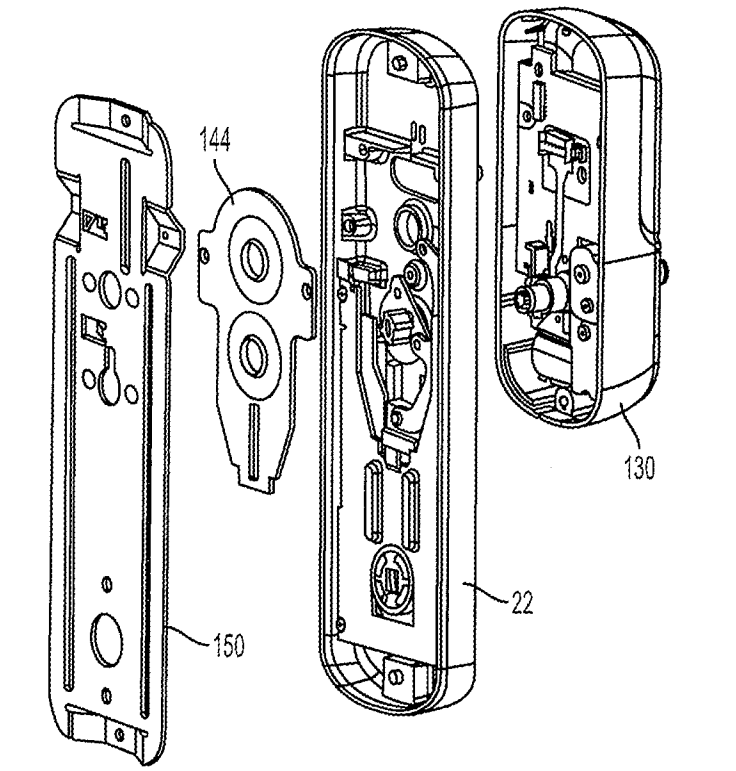
FIG. 3 is an exploded perspective view of an embodiment of the interconnected lock of the present invention for an electromechanical lock assembly.
Figure 2:
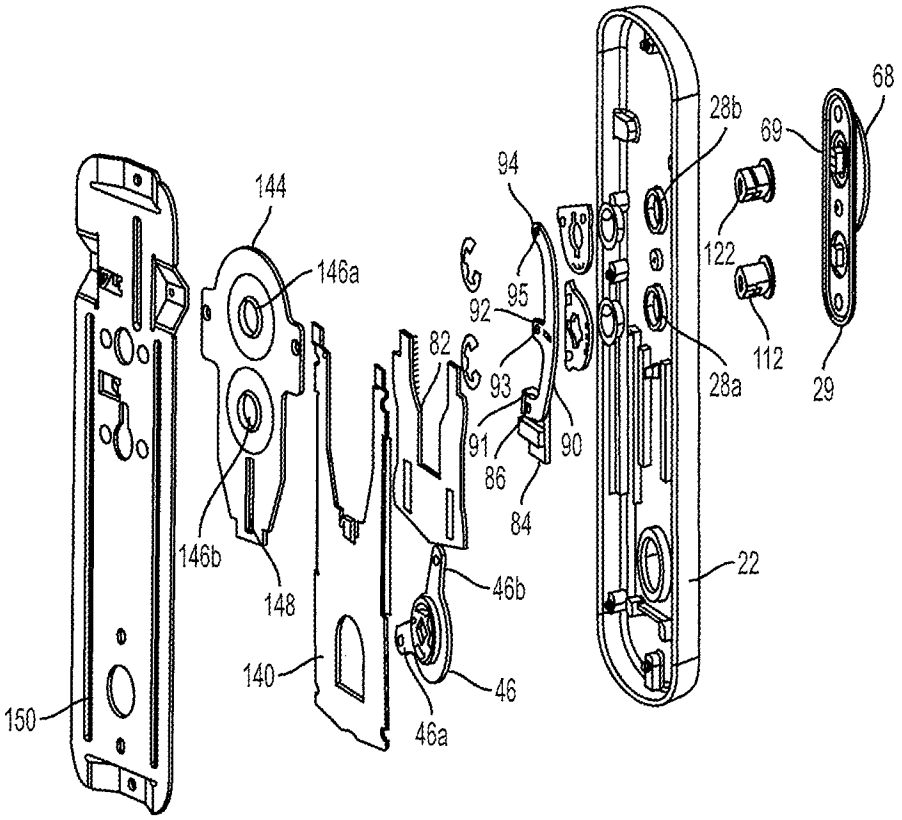
FIG. 2 is an exploded perspective view of an embodiment of the interconnected lock of the present invention for a mechanical lock assembly.
Figure 4:
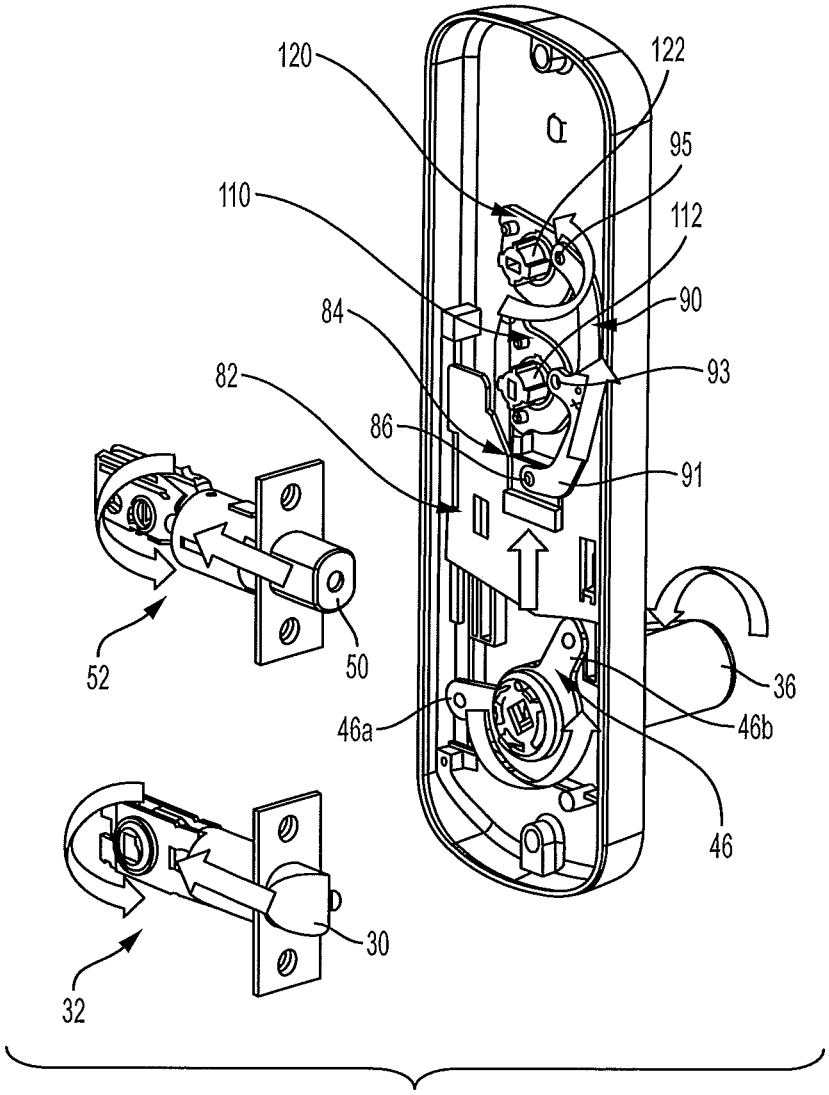
FIG. 4 is a rear perspective, partially exploded view of an embodiment of the interconnected lock of the present invention showing the working components in connection with a deadbolt and a latchbolt.

In describing the embodiment(s) of the present invention, reference will be made herein to FIGS. 1-19 of the drawings in which like numerals refer to like features of the invention.

As shown by an embodiment in the drawings, the interconnected lock 20 of the present invention is mounted and for use on the inside of a door 21 (FIG. 1), where the lock has adjustable offset spacing between a deadbolt 50 and latchbolt 30 extending from door edge 21*a*. A front cover plate or escutcheon 22 encloses the lock assembly 20 over back plate 150 disposed on the inside surface of the door. The interconnected lock includes a latchbolt mechanism 32 mountable in a first bore 34 through the door 21. The latchbolt lock mechanism 32 includes a latchbolt 30 and a manually operated interior actuator or lever 36, here a handle extending laterally from and rotatable about latchbolt actuator driver or shaft 44, operable to move the latchbolt 30 between latched and unlatched positions along a first axis 42. The interconnected lock further includes a deadbolt lock mechanism 52 mountable in a second bore 54 through a door, where the second (deadbolt) bore 54 is spaced from the first (latchbolt) bore 34. The deadbolt lock mechanism 52 includes a deadbolt 50 moveable by the deadbolt lock mechanism 52 along the second axis 56 between latched and unlatched positions, with distance between the latchbolt first axis 42 and the deadbolt second axis 56 being the offset spacing 70. Deadbolt actuator or thumbturn 68 on deadbolt cover plate 29 is rotatable about deadbolt actuator driver or shaft 69 to cause deadbolt mechanism to latch and unlatch deadbolt 50 manually from the inside of the door. As part of the adjustment of lock assembly 20 to the different latchbolt-deadbolt offset distances, thumbturn 68 and shaft 69 are removed from the lock assembly, and deadbolt cover plate 29 may be rotated 180 degrees as shown by arrow 79 (FIG. 7) to align the deadbolt actuator shaft opening to the desired offset position of the deadbolt 50 and deadbolt mechanism 52 before mounting on escutcheon 22. Cover plate 29 then covers the opening 28*a* or 28*b* for deadbolt actuator shaft 69 which is not in use. A fixed tab 27 (FIGS. 5, 6, 8 and 17) on the inside of cover plate 29 engages the cam plate not in use through the escutcheon opening 28*a* or 28*b*, and locks the unused idle cam plate and associated shaft against rotation so that pins 114*a*, 114*b* (on cam plate 110) or pins 124*a*, 124*b* (on cam plate 120) are oriented in a position, e.g., vertically aligned, and do not interfere with movement of the driver member or linkage arm 90.

The interconnected lock 20 also includes a rotatable lower cam plate connected to latchbolt actuator driver or shaft 44 and operable by the interior actuator, the lower cam having a pair of arms 46*a*, 46*b* (FIG. 4) extending outward on opposite sides thereof. Shaft 44 extends beyond cam plate 46 and engages an otherwise conventional latchbolt lock core (not shown) positioned in bore 34, such as a cylindrical or tubular lock, to move latchbolt 30 between its latched and unlatched positions upon rotation of the inner latchbolt actuator. When inner handle 36 is horizontal and latchbolt actuator shaft 44 is in its default position, latchbolt 30 is in its unretracted, latched position, and when inner handle 36 is rotated, latchbolt 30 moves inward to its retracted, unlatched position.

Figure 18:
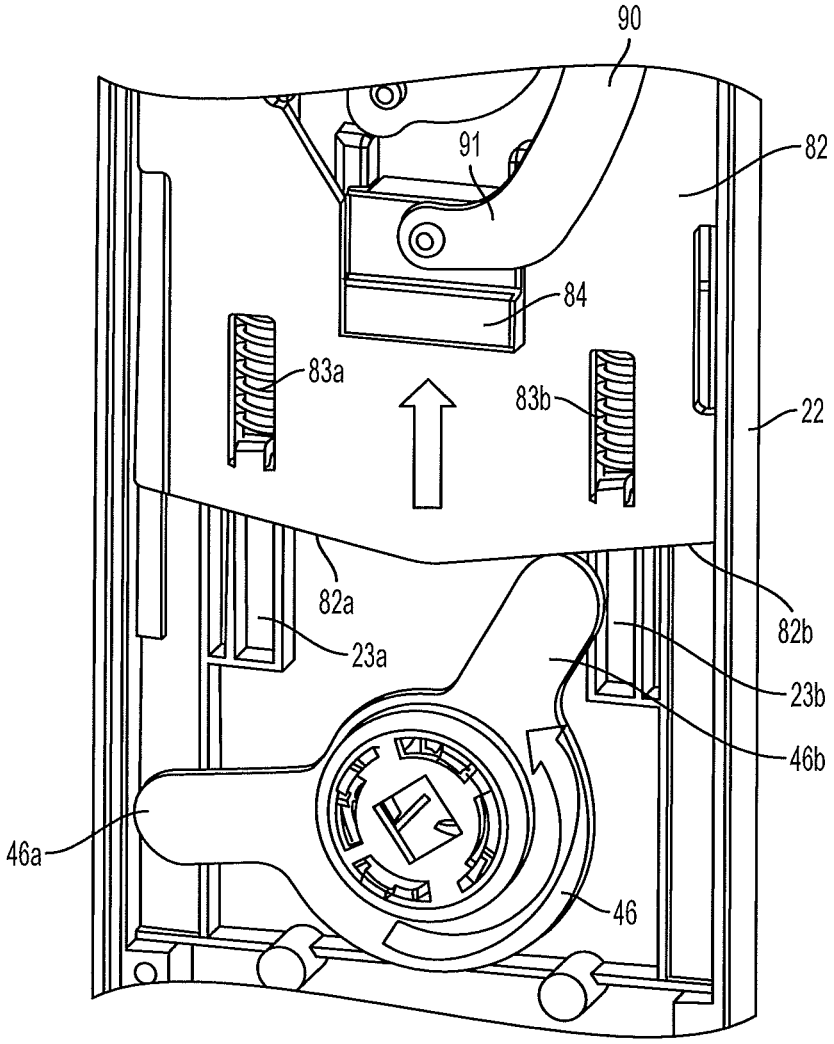
FIG. 18 is a rear perspective view of the interconnected lock of the present invention showing the lower, latchbolt cam plate and lower slider mechanisms.

Slider or sliding mechanism 80 forms part of the mechanism that translates rotation of the latchbolt actuator 36 to retract the deadbolt 50, and comprises lower and upper sliders 82, 84, respectively. Lower slider or sliding mechanism 82 is urged upward by one of the lower cam arms 46*a* or 46*b* when the interior actuator 36 is rotated. As shown in FIG. 18, the lower edges 82*a*, 82*b* of the lower slider contacted by the lower cam arms 46*a*, 46*b*, respectively, are angled from horizontal in the configuration of a shallow "V" so that the edge extends upward from the centerline to each opposite side edge of the lower slider at an acute angle greater than zero, with respect to horizontal. The rotational sliding contact of the lower cam arms 46*a* or 46*b* against the angled lower edges 82*a*, 82*b*, respectively, maximizes the linear travel distance of the lower slider, and increases the output driving torque of the deadbolt driver shaft which is ultimately rotated as described below. Springs 83*a*, 83*b* aligned on either side of a vertical center line are captured between slots 23*a*, 23*b* on the inside of the escutcheon 22 and the lower slider 82. Tabs extending inward from lower slider 82 engage and compress springs 83*a*, 83*b* as lower cam arms 46*a* or 46*b* move the lower slider upward, and the action of the springs urges the lower slider downward when force is removed from the actuator. Upper slider or sliding mechanism 84 is connected to the lower slider at an upper midpoint region. A driver member or linkage arm 90 is removably connected at a lower end 91 by a pin 86 on the upper slider and extends upward therefrom.

The interconnected lock further includes a pair of upper cam plates, one upper cam plate 110 positioned at a first location, e.g., 4 in. (102 mm) from the latchbolt first axis, and the other upper cam plate 120 positioned at a second location, e.g., 5.5 in. (140 mm) from the latchbolt first axis. The first upper cam plate is disposed to be operably connected to the deadbolt lock mechanism 52 by driver or shaft 112 extending therefrom when it is at the first offset distance, e.g., 4 in. (102 mm) from the latchbolt first axis 42 (FIG. 5), and the second upper cam plate is disposed to be operably connected to the deadbolt lock mechanism 52 by driver or shaft 122 extending therefrom when it is at the second offset distance, e.g., 5.5 in. (140 mm) from the latchbolt first axis 42 (FIG. 6).

Deadbolt lock mechanism 52 includes a deadbolt actuator shaft extending from an interior thumbturn 68 through an opening and locking into deadbolt cam plate 110 or 120, depending on the offset distance. Deadbolt bore 54 extends perpendicularly from the inner surface of door 21 to its outer surface (FIG. 1). Deadbolt lock drivers or shafts 112 and 122 extend beyond their respective cam plates 110 and 120 (FIGS. 4, 5 and 6) to engage an otherwise conventional security lock (not shown) in bore 54 operated by a key on the outside of the door or thumbturn on the inside of the door to move deadbolt 50 between its latched and unlatched positions upon rotation of the deadbolt actuator shaft.

Figure 6:
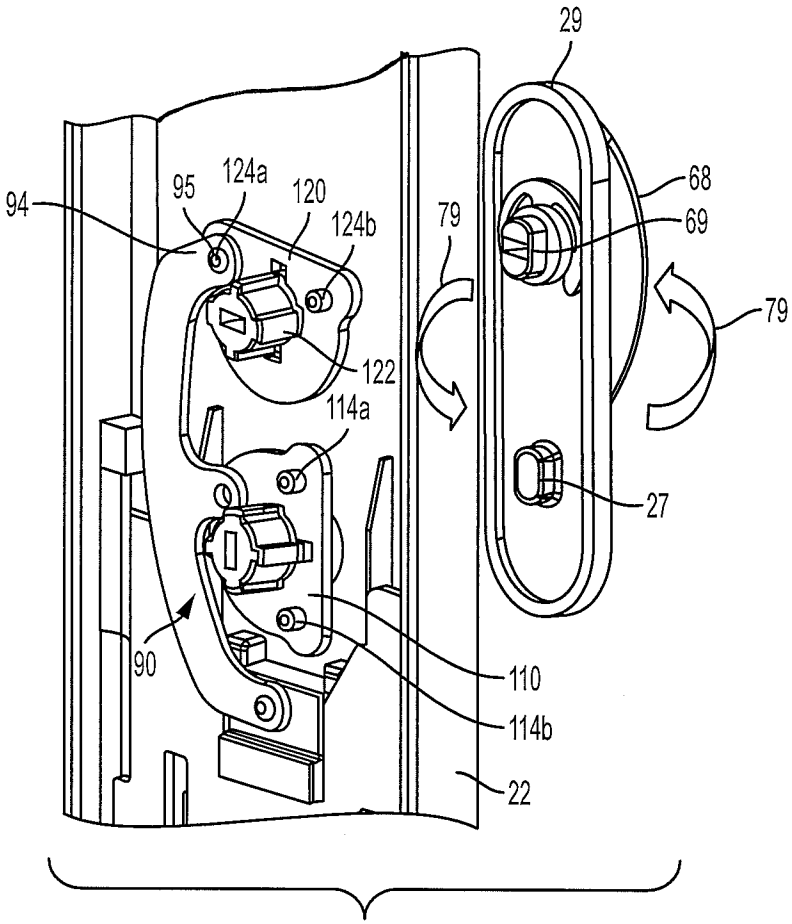
FIG. 6 is a rear perspective, partially exploded view of an embodiment of the interconnected lock of the present invention showing the set up for a latchbolt/deadbolt axis spacing, or offset distance, is at a larger distance, for example, 5.5 in. (140 mm) center to center.
Figure 5:
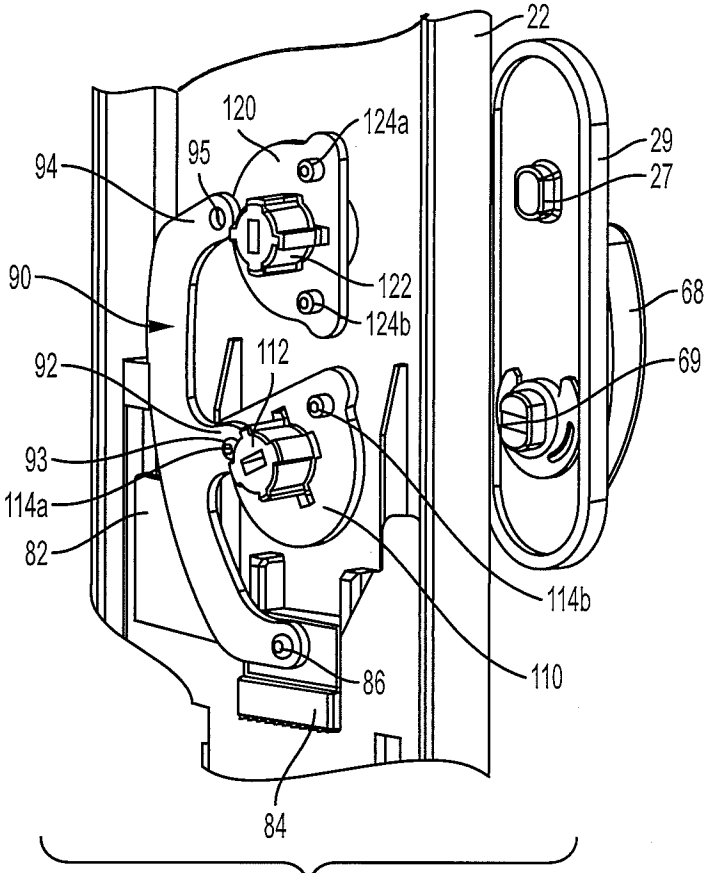
FIG. 5 is a rear perspective, partially exploded view of an embodiment of the interconnected lock of the present invention showing the set up for a latchbolt/deadbolt axis spacing, or offset distance, is at a smaller distance, for example, 4 in. (102 mm) center to center.
Figure 7:
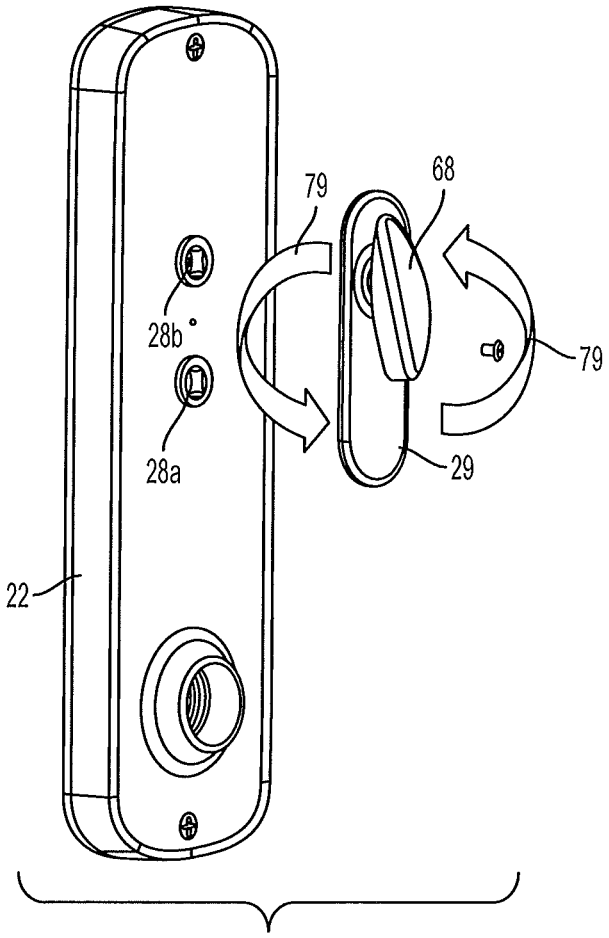
FIG. 7 is a front perspective, partially exploded view of an embodiment of the front cover plate or escutcheon for enclosing the interconnected lock of the present invention showing the reversing thumbturn and deadbolt cover plate for different latchbolt/deadbolt axis spacings.
Figure 8:
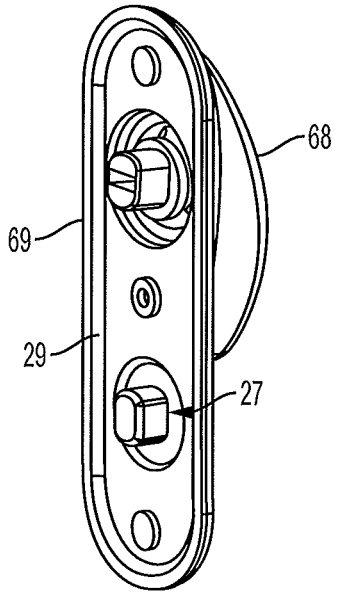
FIG. 8 is a rear perspective view of the reversing thumbturn and deadbolt cover plate of FIG. 7.
Figure 19:
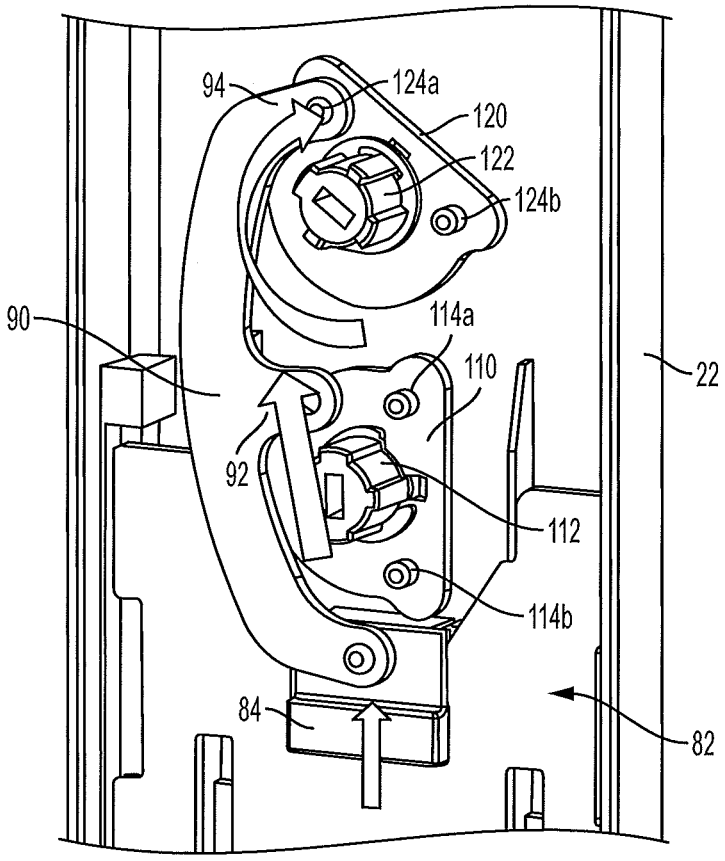
FIG. 19 is a rear perspective view of the interconnected lock of the present invention showing the upper, deadbolt cam plates and upper slider mechanisms.

The linkage arm 90 has a length extending upwards from the upper slider 84 and two upper positions 92, 94 for alternate pin connection to the upper cam plates (FIGS. 5, 6 and 19). Linkage arm 90 is generally curved to be disposed on one side or another of vertically aligned upper cam plate shafts 112, 122, with upper positions 92, 94 extending toward a vertical center line of the escutcheon. First upper position 92 is midway along the linkage length and second upper position 94 is at the upper end of the linkage length. To move the deadbolt 50 along the second axis 56*a* from the latched to the unlatched position when it is at the first offset distance, e.g., 4 in. (102 mm) from the latchbolt first axis 42, an opening 93 in the first linkage upper position 92 may be removably connected to the first upper cam plate 110 by pin 114*a* or 114*b* (FIG. 5) at a location on the cam plate 110 a distance from the second axis 56*a*, to rotate the cam plate 110 as the upper slider 84 is urged upward by the lower slider 82 and lower cam arm 46*a* or 46*b* during rotation of the interior actuator or lever 36. When operating the deadbolt 50 at the first offset spacing, the second upper pin position 94 of the linkage 90 is unconnected to the second upper cam plate 120.

To move the deadbolt 50 along the second axis 56*b* from the latched to the unlatched position when it is at the second offset distance, e.g., 5.5 in. (140 mm) from the latchbolt first axis 42, an opening 95 in the second linkage upper position 94 may be removably connected to the second upper cam plate 120 by a pin 124*a* or 124*b* (FIG. 6) at a location on the cam plate 120 a distance from the second axis 56*b*, to rotate the cam plate 120 as the upper slider 84 is urged upward by the lower slider 82 and lower cam arm 46*a* or 46*b* during rotation of the interior actuator or lever 36. When operating the deadbolt 50 at the second offset spacing, the first upper pin position 92 of the linkage 90 is unconnected to the first upper cam plate 110.

Regardless of the offset spacing between the deadbolt and latchbolt, rotating the inner handle 36 moves the linkage arm 90 upwards, rotating the upper cam plate 110 or 120 operably connected to the deadbolt lock mechanism 52 and automatically retracts both the latchbolt 30 and the deadbolt 50, without having to separately unlock the two. At this point, the user may open the door. After the user is outside and the door is closed, the latchbolt 30 normally returns to the latched position automatically, and the deadbolt 50 may be manually latched by use of a key on an exterior deadbolt security lock 58 or whatever security locking mechanism is employed. It should be noted that operation of the handle 38 on the outer side of the door does not rotate latchbolt cam plate 46, and the deadbolt 50 may only be retracted from the outside of the door by the key or otherwise unlocking the deadbolt security locking mechanism.

Figure 14:
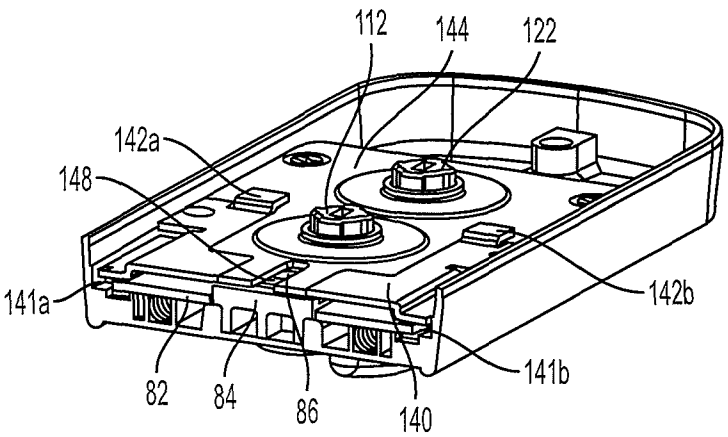
FIG. 14 is a rear perspective sectioned view of the lower portion of the interconnected lock of the present invention showing the guiding channels under the lower cover and the upper and lower sliders.
Figure 13:
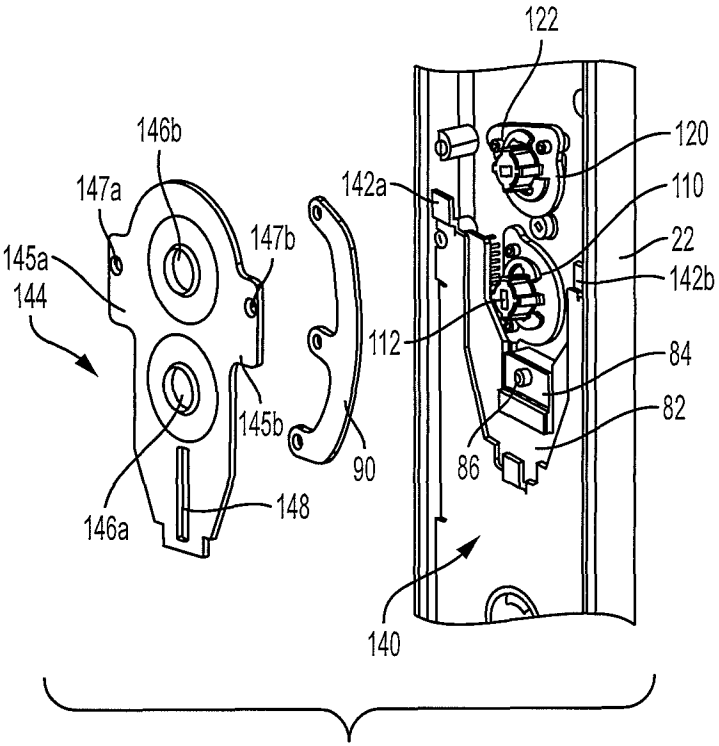
FIG. 13 is a rear perspective, partially exploded view of the interconnected lock of the present invention showing the removable upper cover for easily changing handing of the lock mechanism.
Figure 17:
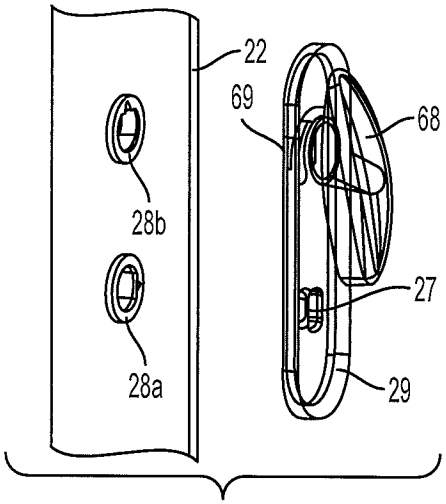
FIG. 17 is a front perspective, partially exploded view of the thumbturn and deadbolt cover plate installation on the escutcheon of the interconnected lock of FIGS. 15 and 16.

To provide for easy installation, the slider mechanism 80, linkage 90 and cam plates 110, 120 are mounted inside the front wall of escutcheon 22, and lower and upper cover plates 140 and 144, respectively are provided thereover. As shown by way of example in FIG. 13, lower cover plate 140 is substantially flat and is securely mounted inside the escutcheon, and is not intended to be removed for offset adjustment or re-handing. Side channels 141*a*, 141*b* shown in FIG. 14 are formed between the escutcheon and the edges of substantially flat lower cover plate 140 to guide the sliding of the edges of lower slider 82 upward and downward, and upward facing tabs 142*a*, 142*b* are provided at the opposite sides of the upper end to retain the edges 145*a*, 145*b*, respectively, of the arms extending laterally on upper cover plate 144. Upper cover plate 144 is intended to be removably secured by screw fasteners through openings 147*a*, 147*b* (FIG. 13) in the lateral arms, so that linkage arm 90 may be accessed and set as needed for offset adjustment or re-handing. Upper cover plate 144 includes central openings 146*a*, 146*b* which align with and serve as bearing journals to support rotation of upper cam plate shafts 112, 122, respectively. A vertically aligned slot 148 guides upward and downward movement of pin 86 holding upper slider 84.

Figure 16:
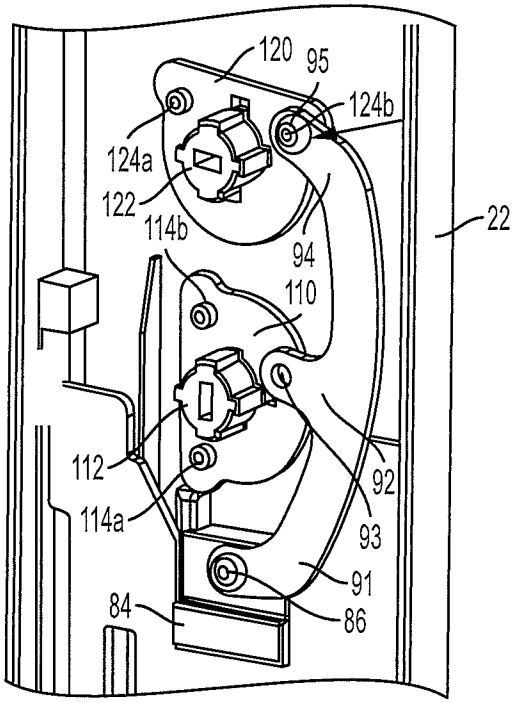
FIG. 16 is a rear perspective view of the interconnected lock of the present invention set up for a 5.5 in. (140 mm) latchbolt/deadbolt axis spacing and a left-hand door installation.
Figure 15:
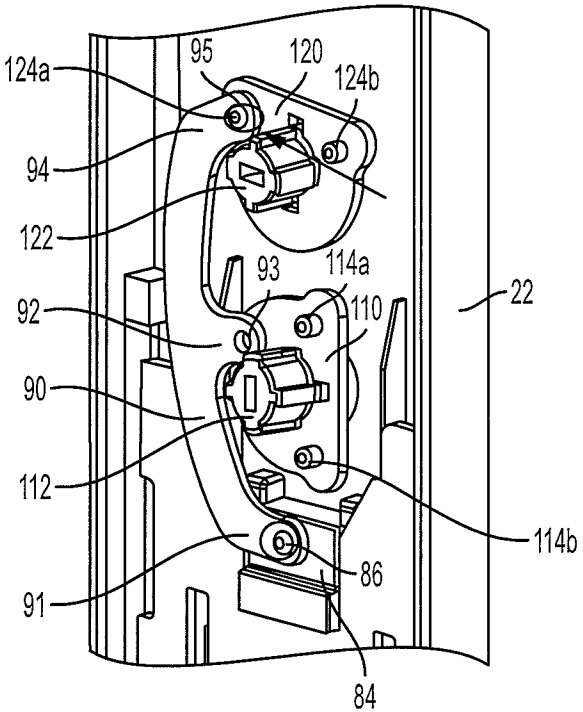
FIG. 15 is a rear perspective view of the interconnected lock of the present invention set up for a 5.5 in. (140 mm) latchbolt/deadbolt axis spacing and a right-hand door installation.

To re-hand or reverse the lock mechanism from right-handed operation to left-handed operation, and vice-versa, the symmetry of the upper slider 84 and upper cam plates 110 and 120 about a central vertical line enables the linkage arm 90 to be easily flipped from one side to the other, as shown by way of example in FIGS. 15 and 16. Using a wider 5.5 in. (140 mm) offset as an example, in a right hand configuration linkage arm lower end 91 is connected to upper slider pin 86, and linkage arm second upper position opening 95 is connected to second upper cam plate pin 124*a*. First upper cam plate 110 at the 4 in. (102 mm) offset is the idle cam, and is locked by tab 27 (FIG. 17) with the pins 114*a*, 114*b* vertically aligned on the side of shaft 112 opposite linkage arm 90, with linkage arm first upper position opening 93 unconnected. To change to the left hand configuration, linkage arm 90 is removed from pins 86 and 124*a*, and flipped around to the other side of shafts 112, 122, and linkage arm lower end 91 is again connected to upper slider pin 86. Linkage arm second upper position opening 95 is then connected to the opposite second upper cam plate pin 124*b*. The idle first upper cam plate 110 rotated 180 degrees and again locked by tab 27 with the pins 114*a*, 114*b* vertically aligned on the side of shaft 112 opposite linkage arm 90. If the 4 in. (102 mm) offset is desired, pins 114*a* (right hand) and 114*b* (left hand) are similarly connected to linkage arm first upper position opening 93. Upper cam plate 120 becomes the idle cam, and is oriented with pins 124*a*, 124*b* aligned vertically opposite the linkage arm, and linkage arm second upper position opening 95 unconnected. Escutcheon openings 28*a*, 28*b* are marked with indicia to indicate right or left hand installation. Other than removing upper cover 144, no tools are required for the re-handing.

Figure 12:
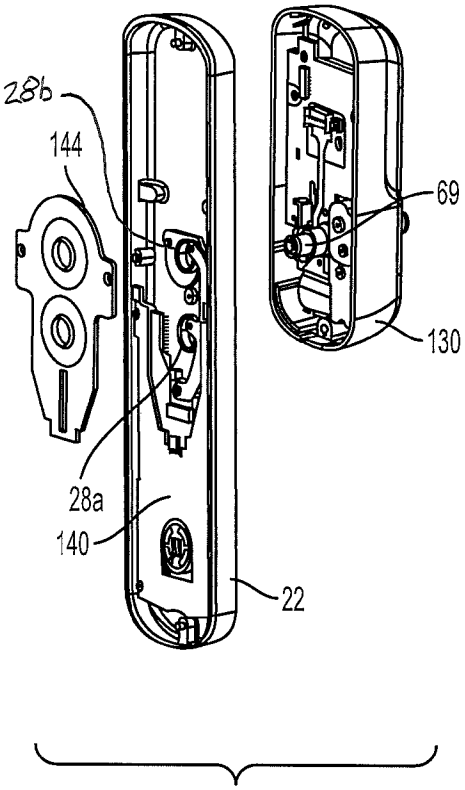
FIG. 12 is a rear perspective, partially exploded view of the escutcheon and electromechanical lock module of FIG. 11.
Figure 11:
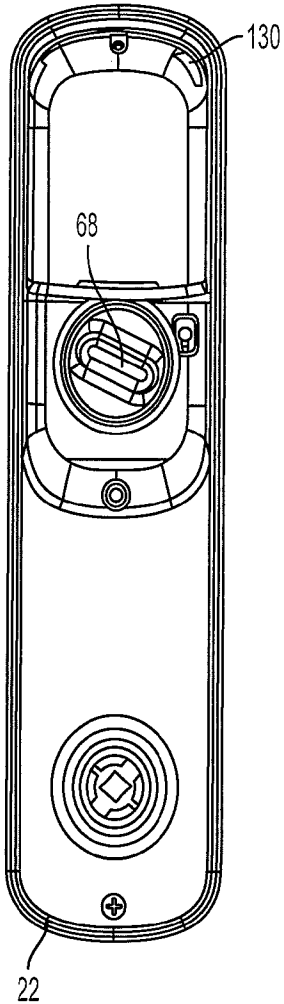
FIG. 11 is a front view of an embodiment of the escutcheon for enclosing an electromechanical lock assembly on the inside of the door in which the latchbolt/deadbolt axis spacing, or offset distance, is at a larger distance, for example, 5.5 in. (140 mm) center to center.
Figure 10:
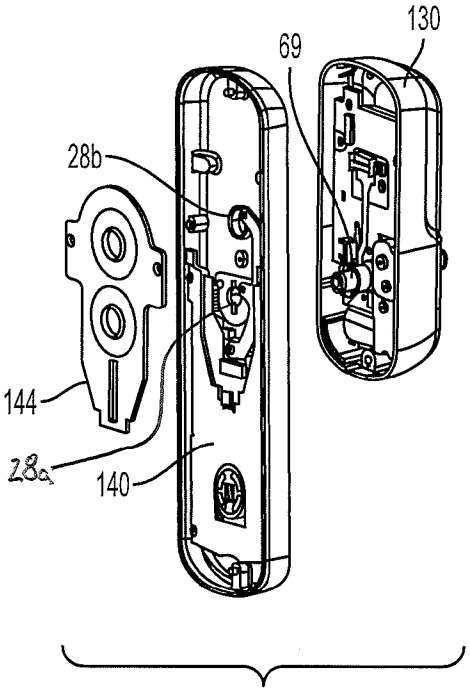
FIG. 10 is a rear perspective, partially exploded view of the escutcheon and electromechanical lock module of FIG. 9.
Figure 9:
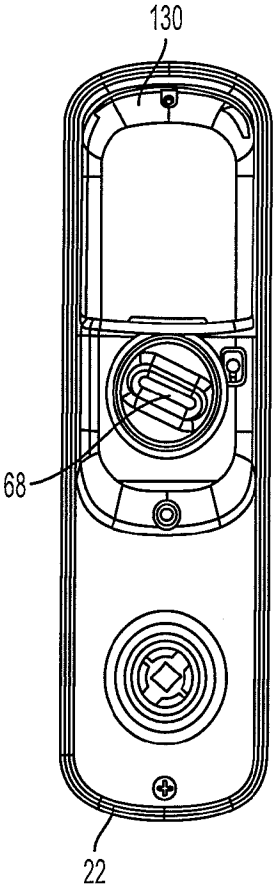
FIG. 9 is a front view of an embodiment of the escutcheon for enclosing an electromechanical lock assembly on the inside of the door in which the latchbolt/deadbolt axis spacing, or offset distance, is at a smaller distance, for example, 4 in. (102 mm) center to center.

The interconnected lock of the present invention permits an electromechanical lock module 130 (FIGS. 3 and 9-12) to be mounted on the escutcheon 22 to engage through openings 28*a* or 28*b* the first or second upper cam plate in use for the desired offset to control the remote latching or unlatching of the deadbolt. FIGS. 9 and 10 show an example of the electromechanical lock module 130 engaging the lower opening 28*a* for the smaller latchbolt/deadbolt offset and FIGS. 11 and 12 show the electromechanical lock module engaging the upper opening 28*b* for the larger latchbolt/deadbolt offset.

Accordingly, the present invention provides an interconnected lock that is able to switch between different latchbolt-deadbolt offset spacings without adding or removing any components thereof. The interconnected lock of the invention may be switched between different latchbolt-deadbolt offset spacings without the potential of losing parts during the spacing adjustment. Additionally, the interconnected lock of the present invention is able to accomplish the switch between different latchbolt-deadbolt spacings without the need for using any tools. The linkage arm adjustment design configuration is an ergonomic and intuitively adjustable solution for the installer and cost effective for the manufacturer. Since no disassembly is required, installation time is reduced.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An interconnected lock for use on a door, where the lock has adjustable offset spacing between a deadbolt and a latchbolt, comprising:

a latchbolt mechanism mountable in a first bore through a door and including the latchbolt and an interior actuator operable to move the latchbolt between latched and unlatched positions along a first axis;

a deadbolt lock mechanism mountable in a second bore through the door, the second bore being spaced from the first bore, the deadbolt being moveable by the deadbolt lock mechanism along a second axis between latched and unlatched positions, a distance between the first axis and the second axis defining the offset spacing, the offset spacing being adjustable between a first offset spacing from the first axis and a second, greater offset spacing from the first axis;

first and second shafts for actuating the deadbolt lock mechanism, the first shaft being disposed at the first offset spacing from the first axis and the second shaft being disposed at the second, greater offset spacing from the first axis; and a driver member connected to and moveable by the interior actuator, the driver member being alternately connectable such that the driver member is connectable to the first shaft to rotate the first shaft when the offset spacing between the first axis and the second axis is the first offset spacing, and connectable to the second shaft to rotate the second shaft when the offset spacing between the first axis and the second axis is the second, greater offset spacing.

2. The interconnected lock of claim 1, wherein the driver member is a linkage arm having a lower end connected to and moveable by the interior actuator, the linkage arm having a length extending upwards with first and second upper linkage arm portions, the first upper linkage arm portion having a first distance from the lower end for connecting to and rotating the first shaft, and the second upper linkage arm portion having a second distance from the lower end for connecting to and rotating the second shaft, the linkage arm being alternately connectable such that the first upper linkage arm portion is connectable to the first shaft to rotate the first shaft when the offset spacing is the first offset spacing, and the second upper linkage arm portion is connectable to the second shaft to rotate the second shaft when the offset spacing is the second, greater offset spacing, to thereby actuate the deadbolt lock mechanism.

3. The interconnected lock of claim 2, further including a rotatable lower cam operable by the interior actuator, the lower cam having a pair of arms extending outward on opposite sides thereof.

4. The interconnected lock of claim 3 further including a sliding mechanism that is configured to be urged upward by one of the arms of the lower cam when the interior actuator is rotated.

5. The interconnected lock of claim 4, wherein the linkage arm is configured to be urged upward by a lower slider portion of the sliding mechanism to rotate the first or second shafts for actuating the deadbolt mechanism.

6. The interconnected lock of claim 5, further including an upper slider portion of the sliding mechanism connected to the lower slider portion, the lower end of the linkage arm being connected to the upper slider portion and extending upward therefrom.

7. The interconnected lock of claim 6, wherein the lower end of the linkage arm is connected by a pin to the upper slider portion.

8. The interconnected lock of claim 5, wherein lower edges of the sliding mechanism configured to be contacted by the arms of the lower cam are angled so as to define a shallow "V"-shape such that the lower edges extend upward from a centerline to opposite side edges of the sliding mechanism at an acute angle greater than zero degrees.

9. The interconnected lock of claim 2, further including first and second upper cam plates, the first upper cam plate connected to the first shaft, and the second upper cam plate connected to the second shaft, and wherein the first and second upper linkage arm portions are alternately connectable to the first and second upper cam plates, respectively.

10. The interconnected lock of claim 9, wherein the first upper linkage arm portion is connectable to the first upper cam plate by at least one first pin, and the second upper linkage arm portion is connectable to the second upper cam plate by at least one second pin, such that when the deadbolt is at the first offset spacing, the first upper linkage arm portion is connected to the first upper cam plate by the at least one first pin and the second upper linkage arm portion of the linkage arm is unconnected to the second upper cam plate, and when the deadbolt is at the second, greater offset spacing, the second upper linkage arm portion is connected to the second upper cam plate by the at least one second pin and the first upper linkage arm portion of the linkage arm is unconnected to the first upper cam plate.

11. The interconnected lock of claim 10, wherein the pins are located on the cam plates or the upper linkage arm portions, and wherein the linkage arm is connectable to the first or second upper cam plates without adding or removing any components of the interconnected lock.

12. The interconnected lock of claim 10, further including a tab configured to engage the first shaft when the first shaft is not connected to the linkage arm to lock the first shaft against rotation, and configured to engage the second shaft when the second shaft is not connected to the linkage arm to lock the second shaft against rotation, and wherein the at least one first pin on the first upper cam plate is configured to be oriented so as to not interfere with movement of the linkage arm when the first shaft is not connected to the linkage arm, and wherein the at least one second pin on the second upper cam plate is configured to be oriented so as to not interfere with movement of the linkage arm when the second shaft is not connected to the linkage arm.

13. The interconnected lock of claim 2, wherein the linkage arm is configured to move the deadbolt along the second axis from the latched position to the unlatched position at the same time that the interior actuator is configured to move the latchbolt along the first axis from the latched position to the unlatched position upon operation of the interior actuator, the linkage arm being alternately connectable for adjusting the offset spacing between the first and second axes, such that the first upper linkage arm portion is connectable to the first shaft to rotate the first shaft when the offset spacing between the first axis and the second axis is the first offset spacing and the second upper linkage arm portion is connectable to the second shaft to rotate the second shaft when the offset spacing between the first axis and the second axis is the second, greater offset spacing, to change the offset spacing between the deadbolt and latchbolt between a first distance, corresponding to the first offset spacing, and a second, longer distance, corresponding to the second, greater offset spacing.

14. The interconnected lock of claim 2, wherein the first and second upper linkage arm portions are alternately connectable to rotate the first and second shafts, respectively, without adding or removing any components of the interconnected lock.

15. The interconnected lock of claim 2, wherein the first and second upper linkage arm portions are alternately connectable to rotate the first and second shafts, respectively, without use of tools.

16. The interconnected lock of claim 2, further including a tab configured to engage the first shaft when the first shaft is not connected to the linkage arm to lock the first shaft against rotation, and configured to engage the second shaft when the second shaft is not connected to the linkage arm to lock the second shaft against rotation.

17. The interconnected lock of claim 1, further including a cover over the driver member, the cover being removable to access the driver member to change connection of the driver member between the first shaft or the second shaft, the cover further having openings therein to support the first and second shafts.

18. A method of re-handing an interconnected lock for use on a door, the method comprising:

providing the interconnected lock of claim 2, wherein the lock further includes first and second upper cam plates, the first upper cam plate connected to the first shaft, and the second upper cam plate connected to the second shaft, the first and second upper linkage arm portions being alternately connectable to the first and second upper cam plates, respectively;

connecting the linkage arm to one side of the first and second upper cam plates for handing the lock for a right-hand operation; and connecting the linkage arm to an other side of the first and second upper cam plates for handing the lock for a left-hand operation.

19. The method of claim 18, wherein the first and second upper linkage arm portions are alternately connectable to the first and second upper cam plates, respectively, by pins located on the one side and the other side; and connecting the linkage arm to one of the pins on the one side of the first and second upper cam plates for handing the lock for a right-hand operation; and connecting the linkage arm to one of the pins on the other side of the first and second upper cam plates for handing the lock for a left-hand operation.

20. A method of adjusting offset spacing between a deadbolt and a latchbolt in an interconnected lock for use on a door, the method comprising:

providing the interconnected lock of claim 2;

operably connecting the linkage arm at the first upper linkage arm portion to the first shaft to rotate the first shaft and thereby actuate the deadbolt lock mechanism when the linkage arm is adjusted to a shorter offset spacing distance defined by the first offset spacing; and operably connecting the linkage arm at the second upper linkage arm portion position to the second shaft to rotate the second shaft and thereby actuate the deadbolt lock mechanism when the linkage arm is adjusted to a longer offset spacing distance defined by the second, greater offset spacing, whereby the first and second upper linkage arm portions are correspondingly connected to positions to the first and second shafts, respectively, without adding or removing any components of the interconnected lock.

* * * * *